United States Patent [19]

Okamura et al.

[11] 4,419,960

[45] Dec. 13, 1983

[54] DEVELOPING AGENT DENSITY CONTROLLING DEVICE

[75] Inventors: Akio Okamura; Shuji Tanaka; Tamotsu Sakamoto, all of Eibna, Japan

[73] Assignee: Fuji Xerox Co., Ltd., Tokyo, Japan

[21] Appl. No.: 415,621

[22] Filed: Sep. 7, 1982

[30] Foreign Application Priority Data

Sep. 8, 1981 [JP] Japan ..... 56-140253

[51] Int. Cl.[3] ..... B05C 11/00; G03G 15/00

[52] U.S. Cl. ..... 118/712; 118/665; 118/691

[58] Field of Search ..... 118/712, 665, 691

[56] References Cited

U.S. PATENT DOCUMENTS 3,897,748 8/1975 Hirata et al. ..... 118/691

*Primary Examiner*—Bernard D. Pianalto

*Attorney, Agent, or Firm*—Sughrue, Mion, Zinn, Macpeak and Seas

[57] ABSTRACT

A device for detecting and controlling developing agent toner density includes a rotating magnet for forming a magnetic brush of developing agent and an electrically conductive glass plate for separating the toner from the carrier so that the density of the toner can be optically measured and used to control the addition of toner to the developing agent.

8 Claims, 3 Drawing Figures

DEVELOPING AGENT DENSITY CONTROLLING DEVICE

BACKGROUND OF THE INVENTION

This invention relates to a toner density controlling device for automatically controlling the toner density of a developing agent in an electronic copying apparatus which uses a developing agent in the form of powder consisting of two components, namely, toner and carrier.

A variety of toner density controlling devices of this type in which the percentage content of toner in a developing agent is optically or electrically detected to provide a detection signal, which is utilized to automatically supply toner, have been proposed in the art.

For instance, (1) In a first example of a conventional density controlling device, the color density variation of the toner in the developing agent is measured to provide an output signal, which is utilized to control the supply of toner, (2) In a second example, the electrical conductivity of the developing agent is measured to provide an output signal, which is utilized to control the supply of toner, (3) In a third example, the specific gravity of the developing agent is measured to provide an output signal, which is utilized to control the supply of toner, and (4) In a fourth example, the variation in a physical characteristic of the developing agent due to a difference in the percentage content of toner, such as for instance the fluidity of the developing agent, is measured to provide an output signal, which is utilized to control the supply of toner.

In the case of example (1), the color density variation of toner is small, and accordingly the accuracy is low. In the case of the second example, the electrical conductivity of the developing agent is small, and accordingly the noise is large. In example (3), it is necessary to perform weight and volume measurements in the copying machine; however, the measurements are low in accuracy because they are liable to be affected by vibration. In the case of the fourth example, the measurement is also liable to be affected by vibration, and the accuracy is therefore low.

As is apparent from the above description, the conventional density controlling devices suffer from difficulties in that the accuracy thereof is low, for example.

SUMMARY OF THE INVENTION

In view of the foregoing, an object of this invention is to provide a developing agent toner density controlling device which can perform density control positively with high accuracy and reliability.

BRIEF DESCRIPTION OF THE DRAWINGS

The accompanying drawings illustrate two embodiments of this invention.

DETAILED DESCRIPTION OF THE PREFERRED EMBODIMENTS

The preferred embodiments of this invention will now be described with reference to the accompanying drawings.

Figure 1:
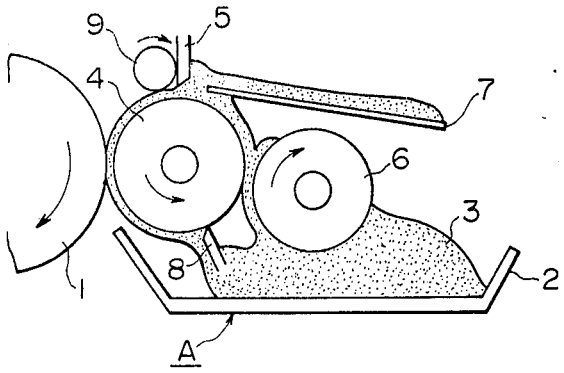
FIG. 1 is a sectional view showing the entire arrangement of one embodiment of the invention.

FIG. 1 is a sectional view for describing the arrangement of the first embodiment of the invention. A magnetic brush developing unit A confronts a photo-sensitive drum 1. The magnetic brush developing unit A comprises a housing 2 containing a developing agent 3, and a developing roll 4, a rise regulating board 5, a conveying roll 6, a developing agent conveying board 7 and a developing agent scraping plate 8 provided in the housing 2. The direction of rotation of the developing roll 4 is opposite to the direction of rotation of the photo-sensitive drum 1. Stationary permanent magnets (not shown) of different polarity are alternately arranged inside of the developing roll 4. The developing agent 3 is formed in the form of a brush on the outer wall of the developing roll 4 (a magnetic brush being formed). After the height of the magnetic brush has heen set to a constant value by the rise regulating board 5, the brush is applied to the surface of the photo-sensitive drum 1 for developing the latent image. The remaining developing agent is removed by being scraped off using the scraping board 8.

The excessive amount of developing agent regulated and removed by the rise regulating board 5 is conveyed backwardly on the developing agent conveying board 7. The developing agent 3 and the developing agent scraped off are than again conveyed to the developing roll 4 by the conveying roll 6.

In FIG. 1, reference numeral 9 designates a developing agent toner density sensor. The developing agent density sensor 9 is positioned in a manner such that it is in contact with the magnetic brush formed on the developing roll 4.

Figure 2:
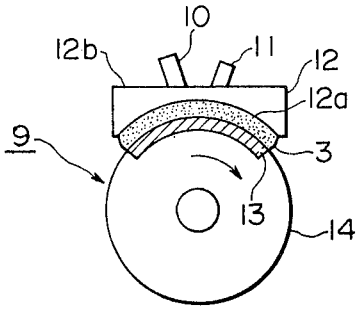
FIG. 2 is a sectional view showing the developing agent toner density sensor of FIG. 1.

The construction of the developing agent density sensor 9 is as shown in FIG. 2, and includes a roll 14 which is turned in a direction opposite to the direction or rotation of the developing roll 14; a permanet magnet 13 buried in or bonded to a portion of the roll 14; an electrically conductive glass plate 12 which is brought into contact with the magnetic brush of the developing agent 3 stuck to the permanent magnet 13; a lamp confronting the rear surface 12*b* of the electrically conductive glass plate 12 for detecting the amount of toner stuck to the surface 12*a* of the glass plate 12; and a light receiving element 11. A voltage is applied to the glass plate 12. The surface 12*a* of the glass plate 12 is equal in curvature to the outer wall of the roll 14.

The operation of the density control device thus constructed will now be described. As the photo-sensitive drum 1 on which an electrostatic latent image has heen formed by a conventional copying method is rotated clockwise and the developing roll 4 is rotated counterclockwise, the developing agent 3 is attracted to and retained on the surface of the developing roll; i.e., a so-called "magnetic brush" is formed. The magnetic brush thus formed is turned counterclockwise together with the developing roll 4.

The height (or thickness) of the magnetic brush is set to a value suitable for development by the rise regulating board 5, and the magnetic brush thus treated is brought into contact with the photo-sensitive drum 1, so that the electrostatic latent image is visualized.

On the other hand, developing agent which has not been used for development and has been retained on the surface of the developing roll 4 is scraped off by the developing agent scraping board 8. The developing agent thus scraped off is recovered in the housing 2. The developing agent thus recovered is again delivered to the developing roll 4 by the conveying roll 6 after being sufficiently agitated, to thus form a magnetic brush again.

The developing agent removed from the magnetic brush by the rise regulating board is conveyed backwardly on the developing agent conveying board 7.

Before contacting the photo-sensitive drum 1, the magnetic brush contacts the developing agent toner density sensor 9 disposed near the developing roll 4 and accordingly the roll 14 which is rotated clockwise.

In this operation, the developing agent forms a small magnetic brush due to the attraction of the permanent magnet 13. The magnetic brush thus formed is turned clockwise together with the roll 14 and is brought into contact with the surface of the electrically conductive glass plate 12 to which a voltage has been applied.

At this moment, the toner and carrier which are electrostatically attracted are separated from one another, as a result of which the toner becomes stuck to the surface of the electrically conductive glass plate 12, to thus form a toner image.

After the magnetic brush has passed through the glass plate 12, the lamp 10 is caused to emit light. The light thus emitted passes through the glass plate 12 to which the toner is adhered, and is reflected by the surface of the roll 14. The light thus reflected then passes through the glass plate 12 and reaches the light receiving element 11, which detects the quantity of light received.

The quantity of light thus detected depends on the amount of toner (or the density of toner) on the surface of the electrically conductive glass plate 12. Therefore, the density of the developing agent can be controlled so as to be within a predetermined range by employing a method in which a toner supplying mechanism (not shown) is controlled according to the quantity of light detected, to thereby increase or decrease the quantity of toner supplied into the housing 2.

As only the toner becomes adhered to the surface of the electrically conductive glass plate 12, the density of the toner can be accurately detected. Thus, developing agent toner density control can be carried out positively with high accuracy and reliability.

Figure 3:
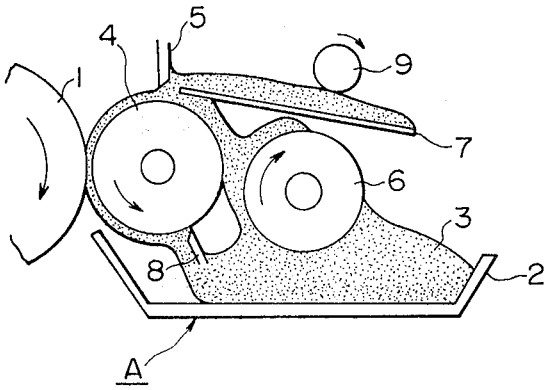
FIG. 3 is a sectional view showing the arrangement of another embodiment of the invention.

In the above-described embodiment, the developing agent toner density sensor 9 is positioned above the developing roll 4; however, the invention is not limited thereto or thereby. That is, the sensor 9 may be disposed above the developing agent conveying board 7 as shown in FIG. 3. In other words, the sensor 9 can be positioned anywhere in the flow path of developing agent.

With the above construction, the density control device according to the invention can maintain the density of the developing agent within a predetermined range. Only the toner in the developing agent is caused to stick to the electrically conductive glass plate 12, the density of the toner image formed on the glass plate 12 is optically detected, and the amount of toner to be supplied is controlled according to the detection value, according to the invention. Therefore, the density of the toner only can be measured directly. Accordingly, developing agent toner density control according to the invention is positive, and of high accuracy and reliability.

What is claimed is:

1. A developing agent toner density controlling device, comprising;

means disposed in the flow path of a developing agent and including a permanent magnet for forming a magnetic brush of developing agent;

electrically conductive means confronting said permanent magnet for forming a toner image thereon by contacting said magnetic brush; and means for detecting the amount of toner in said image formed on a surface of said electrically conductive means, to control an amount of toner supplied to said developing agent.

2. A device as claimed in claim 1, wherein said detecting means comprises optical detection means.

3. A device as claimed in claim 1, said electrically conductive means comprising a glass plate having a surface upon which said toner image is formed, and further including optical detection means for detecting the amount of said toner on said surface, and disposed adjacent a back surface of said glass plate.

4. A device as claimed in claim 3, said means disposed in said flow path comprising a rotating roll mounting said permanent magnet, said optical detection means and said glass plate being mounted adjacent said roll, said glass plate having a curvature on said surface thereof matching that of said roll.

5. A device as claimed in claim 1, said means disposed in said flow path comprising a rotating roll arranged closely spaced from a developing roll of an associated developing unit.

6. A device as claimed in claim 1, said means disposed in said flow path comprising a rotating roll arranged in a housing of a developing unit including a developing roll, means for forming a magnetic brush on said developing roll, means for removing excess developing agent from said developing roll and conveying means for said removed excess, said rotating roll being arranged confronting said conveying means.

7. A device as claimed in claim 4, said glass plate being arranged on a side of said roll opposite to a side normally contacting said developing agent, said magnet being inset into a portion of said roll.

8. A device as claimed in claim 3, said optical detection means including a light source for directing light onto said surface of said glass plate from said back surface thereof, and light detecting means for detecting a quantity of light reflected from a surface behind said surface of said glass plate.

* * * * *